United States Patent [19]

Sisk

[11] 4,312,303

[45] Jan. 26, 1982

[54] RECIRCULATING STEAM GENERATOR WITH SUPER HEAT

[75] Inventor: Francis J. Sisk, Washington, Pa.

[73] Assignee: Westinghouse Electric Corp., Pittsburgh, Pa.

[21] Appl. No.: 78,752

[22] Filed: Sep. 25, 1979

[51] Int. Cl.[3] ..... F22B 1/02

[52] U.S. Cl. ..... 122/34; 122/483

[58] Field of Search ..... 122/32, 33, 34, 483; 165/159, 160

[56] References Cited

U.S. PATENT DOCUMENTS

| | | | |
|---|---|---|---|
| 3,385,268 | 5/1968 | Sprague | 122/32 |
| 3,447,509 | 6/1969 | Sprague | 122/32 |
| 3,545,412 | 12/1970 | Kinyom | 122/34 |
| 3,576,179 | 4/1971 | Romanos | 122/32 |
| 3,683,866 | 8/1972 | Zmola | 122/34 X |
| 4,068,627 | 1/1978 | Giesecke | 122/34 |

*Primary Examiner*—Edward G. Favors

*Attorney, Agent, or Firm*—F. J. Baehr, Jr.

[57] ABSTRACT

A vertically oriented straight tube steam generator is provided with a boiling portion having tilted baffles to ensure recirculation and nucleate boiling irrespective of the water level and a superheater portion above the water level which allows varying water level for load and pressure control of the steam generator.

9 Claims, 6 Drawing Figures

RECIRCULATING STEAM GENERATOR WITH SUPER HEAT

BACKGROUND OF THE INVENTION

This invention relates to a steam generator for nuclear power plants and more particularly to a recirculating steam generator having a superheat portion disposed therein.

A counterflow steam generator having a boiling portion and a superheating portion offers a wide range of operating conditions and in particular improved partial-load operation by varying the pressure and water level within the steam generator.

U.S. Pat. Nos. 3,576,179; 3,385,268 and 3,447,509 show straight tube steam generators of the oncethrough design with a superheater section, but do not provide recirculation in the boiling portion of the steam generator.

SUMMARY OF THE INVENTION

In general, a heat exchanger, in which a primary fluid supplies heat to vaporize a secondary fluid, when made in accordance with this invention, comprises a vertically oriented shell, a plurality of tubes disposed generally vertically in the shell through which the primary fluid flows in a downward direction. The shell is divided into an upper super heating portion and a lower boiling portion. A plurality of baffles are disposed in the superheating portion to cause the secondary fluid to follow a sinuous path over the outer side of the tubes. The steam generator also comprises a plurality of spaced apart tilted baffles disposed in the boiling portion of the shell. These tilted baffles extend upwardly to form an upwardly inclining flow path between adjacent tilted baffles whereby superheated vapor is produced and the gross circulation pattern is not changed irrespective of the level at which the steam generator is operated.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
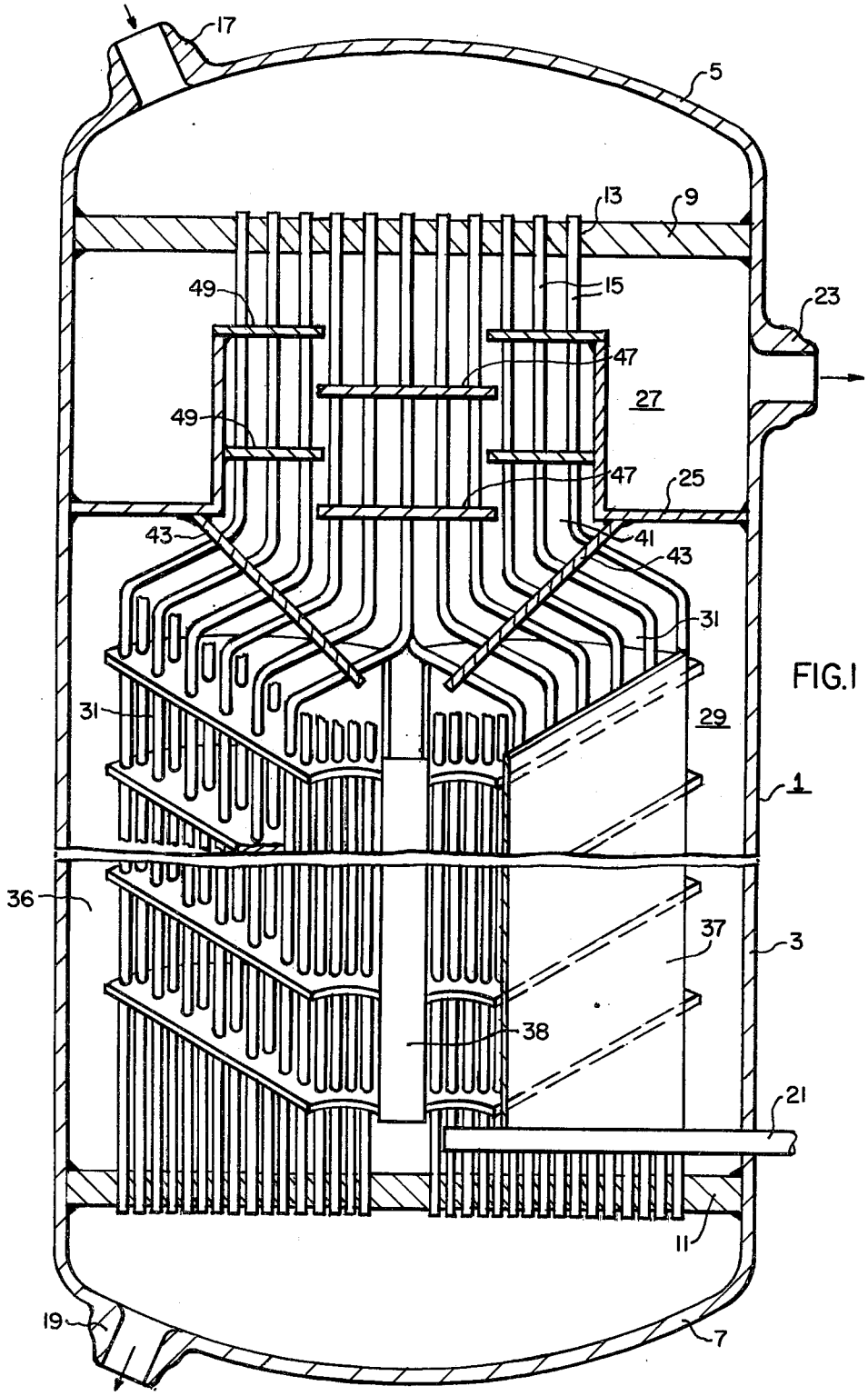
FIG. 1 is a sectional view of a steam generator made in accordance with this invention.

Referring now to the drawings in detail, and in particular to FIG. 1, there is shown a steam generator 1 having a vertically oriented cylindrical shell 3 with flanged and dished heads 5 and 7 forming the end closures for the shell 3. Tubesheets 9 and 11 are disposed, respectively, adjacent the upper and lower ends of the shell 3 and have a plurality of holes 13 disposed on a square pitch. However, it is understood that a triangular pitch could also be utilized. A plurality of tubes 15 are generally vertically oriented in the shell 3, extend through the holes 13 in the tubesheets 9 and 11, are expanded into engagement therewith, and are seal welded thereto.

Primary fluid inlet and outlet nozzles 17 and 19, respectively, are disposed, respectively, in the upper and lower heads 5 and 7, whereby primary fluid flows downwardly inside the tubes 15. A secondary fluid inlet nozzle 21 is disposed in the lower portion of the shell 3 above the tubesheet 11 admitting influent secondary fluid to the lower portion of the shell 3 and a secondary fluid outlet nozzle 23 is disposed in the upper portion of the shell below the upper tubesheet 9 providing a counterflow relation between the primary and secondary fluid.

A transverse baffle 25 is disposed in the upper portion of the shell 3 and generally divides the shell into a superheating portion 27 above the transverse baffle 25, and a boiling and separating portion 29 below the transverse baffle 25.

Figure 2:
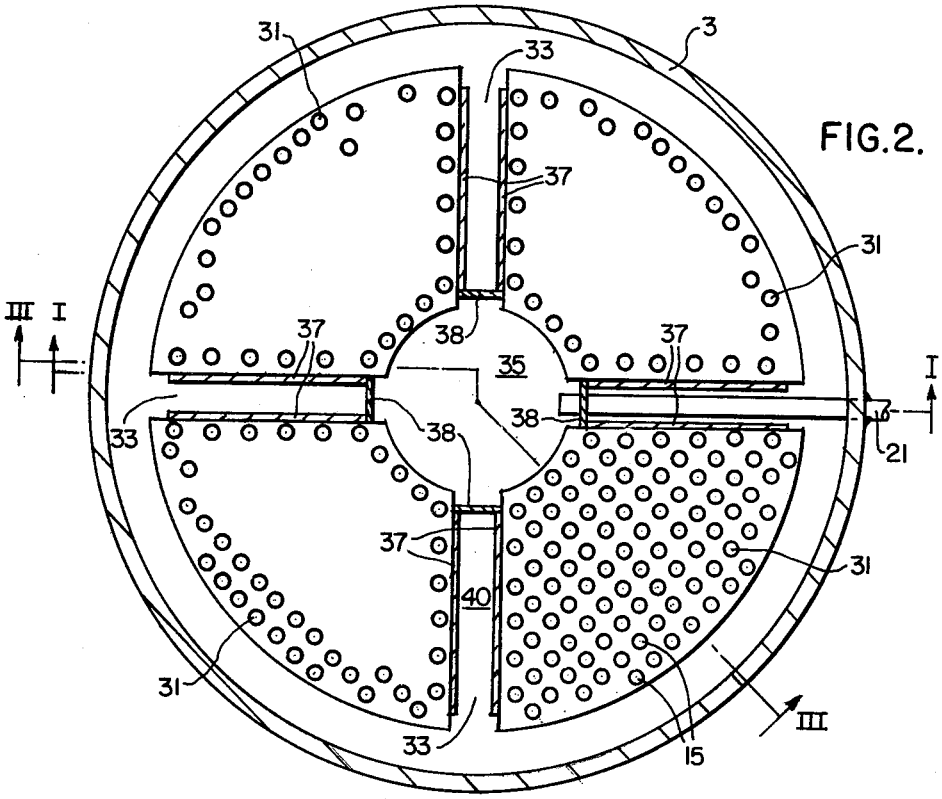
FIG. 2 is a sectional view taken on line II—II of FIG. 1.
Figure 3:
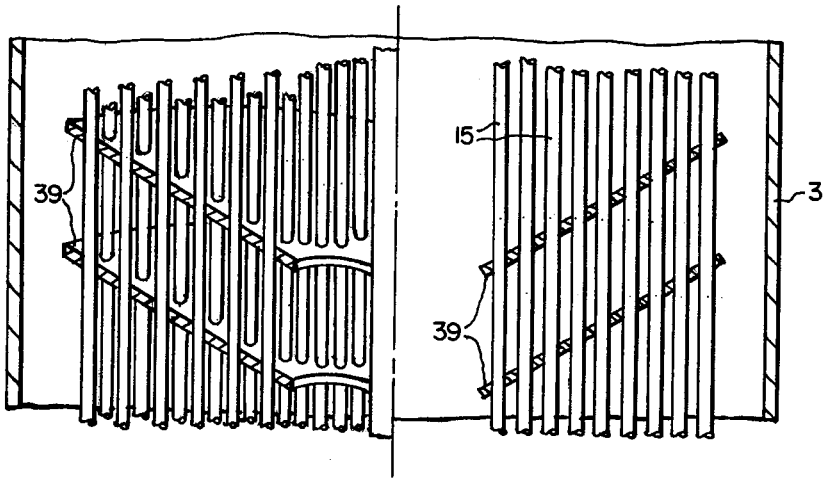
FIG. 3 is a sectional view taken on line III—III of FIG. 2.

As shown in FIG. 2, the tubes 15 disposed in the boiling portion 29 are grouped in nests or clusters 31, which are disposed in a circular array with open lanes 33 between adjacent clusters 31, a centrally disposed open lane 35 in the middle of the clusters 31 and an annular space 36 adjacent the shell 3.

Vertically oriented baffles 37 are disposed on two sides of each tube cluster 31 and extend upwardly and outwardly from the central portion of the shell 3. The baffles 37 generally extend from the lower tubesheet to below the transverse baffle 25. Vertically oriented lane blocks 38 are disposed on the radially inner end of the vertical baffles 37 and terminate above the lower tubesheet 11 to provide downcomer passages 40 for recirculating the secondary liquid.

A plurality of tilted baffles 39 are also disposed in the lower portion of the shell 3. The tilted baffles 39 are disposed in the clusters 31 and generally extend between the vertical baffles 37 on two sides of each cluster 31 and are tilted upwardly as they extend outwardly from the central portion of the shell. The tilted baffles 39 are spaced on a sufficiently close pitch and sufficiently small slope that the baffle overlap is preserved to ensure that only a minimal portion of the topmost tilted baffles 39 are in a non-circulative boiling mode and are effective to direct the mixture of steam and water to the annular space 36 where the steam may progress upwardly and the water separates therefrom and returns via the downcomer passages 40 formed by the walled lanes 33 and lane blocks 38 to preserve nucleate boiling.

The transverse baffle 25 has an opening 41 disposed to allow steam to flow to the superheating portion 27 wherein the tubes 15 are bent inwardly to form a closely packed tube array generally with no lanes or extensive open spaces.

Tilted baffles 43 and a plurality of generally horizontal baffles 47 and 49 are disposed in the superheating portion 27 of the steam generator to cause the steam to follow a sinuous path over the outer surface of the tubes 15.

Figure 4:
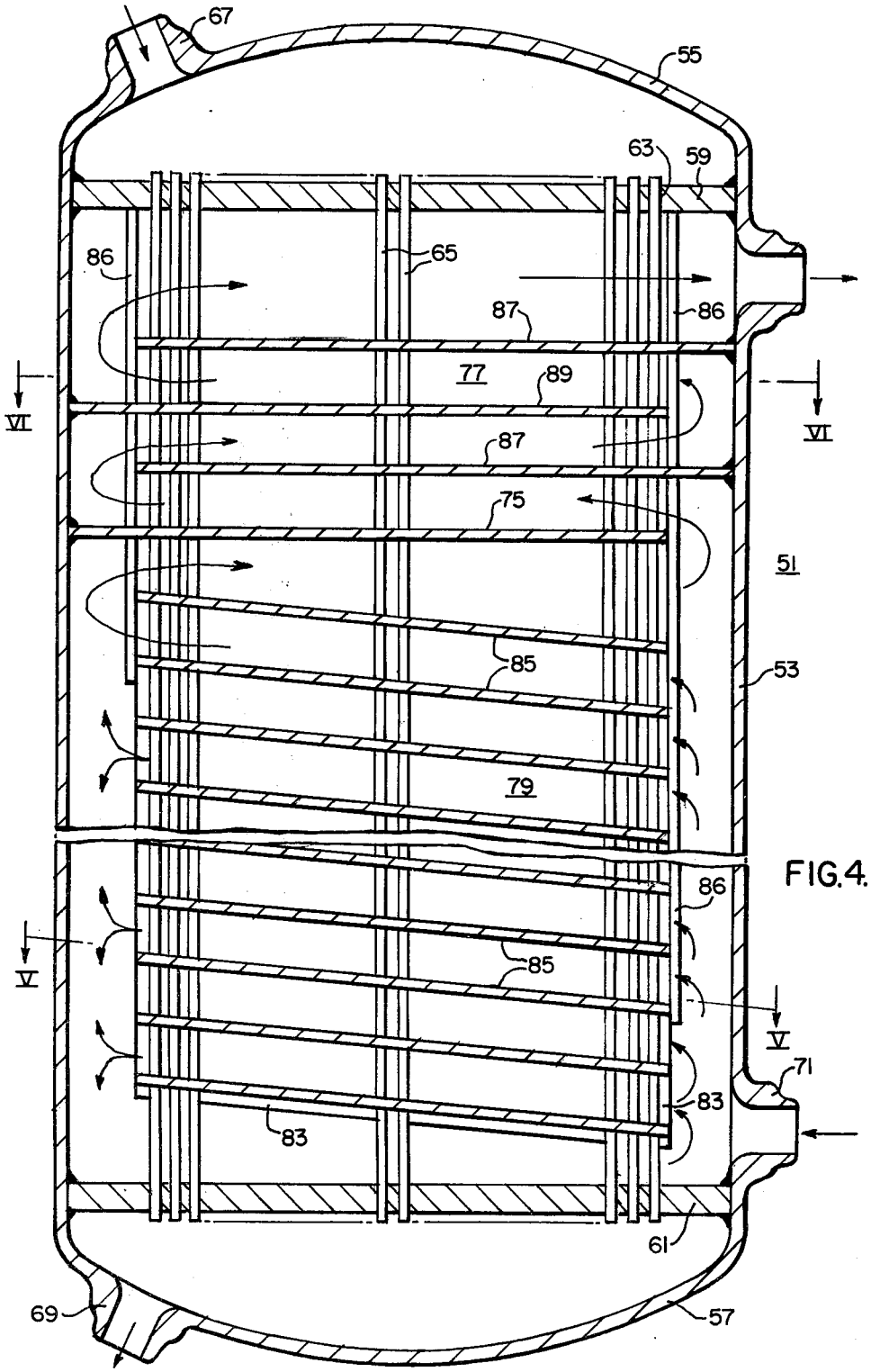
FIG. 4 is a sectional view of an alternate steam generator.
Figure 5:
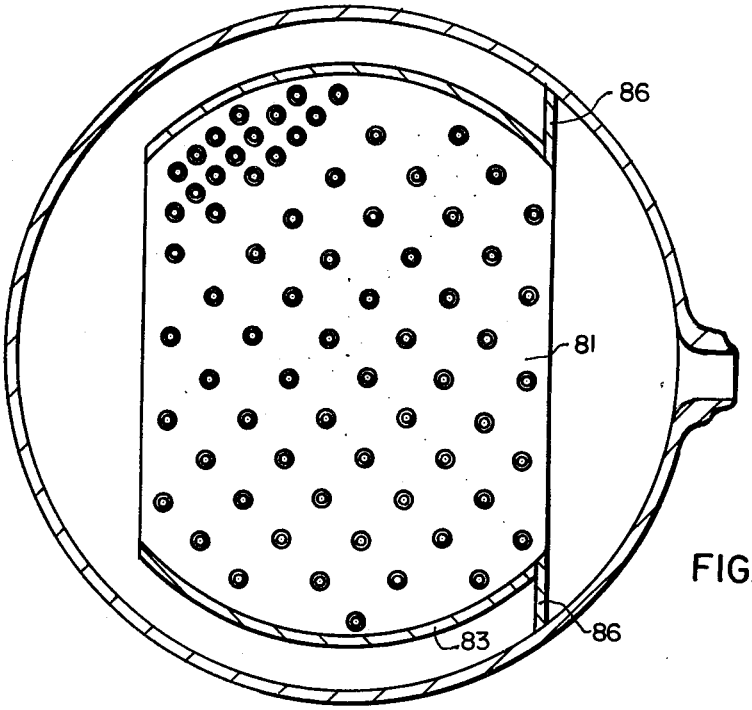
FIG. 5 is a sectional view taken on line V—V of FIG. 4.
Figure 6:
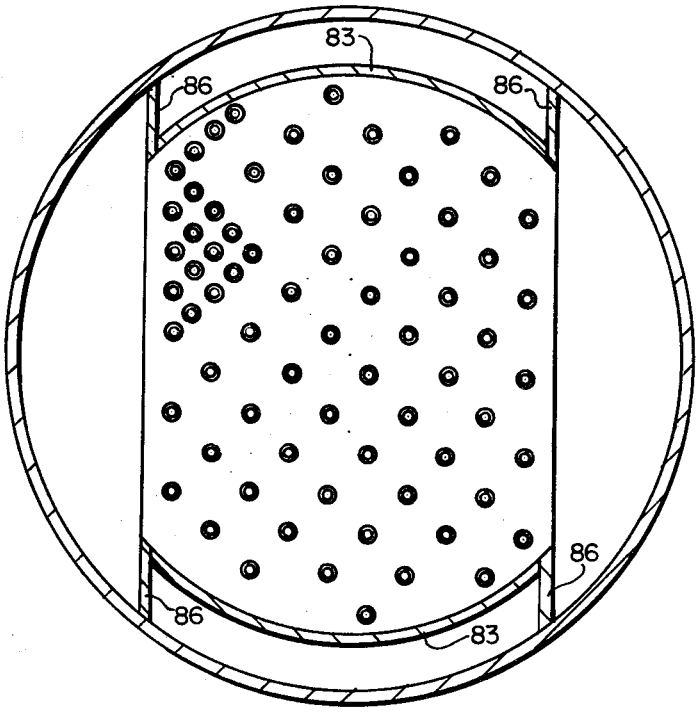
FIG. 6 is a sectional view taken on line VI—VI of FIG. 4.

As shown in FIGS. 4, 5 and 6, another embodiment of a steam generator 51 has a vertically oriented cylindrical shell 53 with flanged and dished heads 55 and 57 forming the end closure of the shell 53. Tubesheets 59 and 61 are disposed, respectively, adjacent the upper and lower ends of the shell 53 and have a plurality of holes 63 disposed on a square pitch. However, it is understood that a triangular pitch could also be utilized. A plurality of generally straight tubes 65 are vertically oriented in the shell 53, extend through the holes 63 in the tubesheets 59 and 61, are expanded into engagement therewith, and are seal welded thereto.

Primary fluid inlet and outlet nozzles 67 and 69, respectively, are disposed, respectively, in the upper and lower heads 55 and 57, whereby primary fluid flows downwardly inside the tube 65. A secondary fluid inlet nozzle 71 is disposed in the lower portion of the shell 53 above the tubesheet 61 admitting influent secondary fluid to a lower portion of the shell 53 and a secondary fluid outlet nozzle 73 is disposed in the upper portion of the shell 53 below the upper tubesheet 59 providing a counter flow relationship between the primary and secondary fluid.

A transverse baffle 75 is disposed in the upper portion of the shell 53 and generally divides the shell into a superheating portion 77 above the transverse baffle 25 and a boiling portion 79 below the transverse baffle 75. As shown in FIGS. 5 and 6, the tubes 65 are disposed in a closely packed tube bundle 81 which can vary in cross section to maximize the heat transfer surface and provide the necessary access path for recirculation. Vertical baffle 83 is disposed on opposite sides of the tube bundle 81.

In the boiling portion 79, there are a plurality of spaced apart tilted baffles 85 which tilt upwardly to form a plurality of upwardly inclined flow passages. The tilted baffles 85 are spaced on a sufficiently close pitch and have a sufficiently small slope that the baffle overlap is preserved to ensure that only a minimal portion of the top-most tilted baffles 85 are in non-circulative boiling mode and are effective to direct steam upwardly to the superheater portion 77. Vertical lane blocks 86 are disposed on both ends of the vertical baffles 83 in the superheater portion 77 and only on the ends adjacent the lower end of the tilted baffles 85 in the boiling portion 79. In the boiling portion 79 the lane blocks 86 terminate above the lower tubesheet 61 to provide downcomer passages for maintaining recirculation and preserving nucleate boiling. The transverse baffle 75 has an opening on one side and cooperates with other transverse baffles 87 and 89 having an opening on one side, the vertical baffles 83 and the lane blocks 86, to cause the steam to follow a sinuous path over the outside of the tubes 65 in the superheater portion 77.

The steam generators 1 and 51 hereinbefore described advantageously provides a superheater 27, guided path recirculation at low void fraction, variable water line for load-pressure control, a circulation geometry unaffected by water line level, and virtually complete regression of departure from nucleate boiling by providing a primary fluid single-path downflow in the vertical tube clusters, bounded by vertical water passes, and mixture passes; tilted baffles spaced at a sufficiently close pitch and tilted at a sufficiently small slope that baffle overlap is provided to ensure that only a minimal portion of the top pass is operating a non-circulative boiling, which allows for varying water level operation as water drains out of the upward flowing mixture and returns to the water passage while the steam flows upwardly in the unbaffled annular portion adjacent the shell to the superheating surface, which is disposed above the full-load water level to assure pressure load control without changing the gross circulation pattern of the steam generator.

What is claimed is:

1. A heat exchanger in which a primary fluid supplies heat to vaporize a secondary fluid, said heat exchanger comprising:

a vertically oriented shell with a secondary fluid inlet and outlet, a plurality of tubes generally disposed vertically in said shell, said tubes being disposed in clusters with open lanes between adjacent clusters, said primary fluid flowing in a downward direction through said tubes, a transverse baffle dividing said shell into an upper superheating portion and a lower vaporizing portion, a plurality of baffles disposed in the superheating portion to cause said secondary fluid to follow a sinuous path over the outer side of said tubes, a plurality of tilted baffles disposed in said vaporizing porton of said shell, said tilted baffles being inclined upwardly, and return means for recirculating unvaporized secondary fluid from the upper to the lower end of said tilted baffles whereby said vaporizing portion operates in recirculating mode.

2. A heat exchanger as set forth in claim 1, wherein there is also a centrally disposed lane between said clusters.

3. A heat exchanger as set forth in claim 1 and further comprising vertically extending baffles on two sides of each tube cluster disposed in the vaporizing portion of the shell.

4. The heat exchanger as set forth in claim 1, wherein the clusters are so disposed to provide an annular space adjacent the shell in the vaporizing portion thereof.

5. A heat exchanger as set forth in claim 2, wherein the secondary fluid inlet is disposed to deliver influent secondary fluid to lower end of the centrally disposed lane.

6. A heat exchanger as set forth in claim 1, wherein the clusters are disposed in a circular array.

7. A heat exchanger as set forth in claim 1, wherein there are four clusters disposed in a circular array.

8. A heat exchanger in which a primary fluid supplies heat to vaporize a secondary fluid, said heat exchanger comprising:

a vertically oriented shell, a plurality of tubes disposed in said shell, a superheating portion in the upper portion of said shell, a vaporizing portion in the lower portion of said shell, said tubes disposed in said vaporizing portion being disposed in clusters with open lanes between adjacent clusters and a centrally disposed lane between the clusters, a plurality of vertical baffles disposed on two sides of each cluster and bounding the lanes between adjacent clusters, a plurality of tilted baffles disposed in each cluster, said tilted baffles being tilted upwardly and outwardly from a central portion of said boiling portion of said heat exchanger, and an annular space between the cluster and the shell,, said tilted baffles, said lanes between adjacent clusters and said annular space cooperating to provide recirculation of liquid entering the annular space and to provide a passage for the vapor to flow to said superheating portion of said heat exchanger.

9. A heat exchanger as set forth in claim 1, wherein said baffles in the superheating portion comprise vertically extending baffles bounding the tubes and transverse baffles which cooperate to form a sinuous path for vapor as it flows from said vaporizing portion to said secondary fluid outlet.

* * * * *